United States Patent [19]

Hayes et al.

[11] 4,179,030

[45] Dec. 18, 1979

[54] UNITARY FOLDABLE DISPENSER REEL AND CONTAINER WITH REMOVABLE DISPENSER PORTION

[75] Inventors: James L. Hayes, Garden Grove; John T. Greenslade, El Toro, both of Calif.

[73] Assignee: Eltra Corporation, Toledo, Ohio

[21] Appl. No.: 963,401

[22] Filed: Nov. 24, 1978

[51] Int. Cl.[2] ..... B65D 85/67

[52] U.S. Cl. ..... 206/396; 229/17 S; 242/137.1

[58] Field of Search ..... 206/396, 395; 229/17 S; 242/118.8, 137.1

[56] References Cited

U.S. PATENT DOCUMENTS

| | | | |
|---|---|---|---|
| 2,890,821 | 6/1959 | Becker | 229/17 S X |
| 3,229,812 | 1/1966 | Metzger | 206/396 |
| 3,246,742 | 4/1966 | Coe | 206/396 |
| 3,329,259 | 7/1967 | Mayer | 206/396 |

*Primary Examiner*—Donald F. Norton
*Attorney, Agent, or Firm*—Fischer and Tachner

[57] ABSTRACT

A dispenser reel and container are integrated into a unitary foldable structure which when folded into an assembled configuration, is suitable for the shipping and dispensing of a spool of wire, cable, and the like, that may be wound on a spindle or other hollow cylindrical core device. In one embodiment, the invention is fabricated out of flat corrugated paperboard that is easily cut to appropriate dimensions and provided with fold creases or score lines that make it readily foldable around the packaged spool of cable or the like. In said one embodiment, the cut corrugated paperboard comprises two interconnected substantially rectangular portions and two interconnected substantially circular portions, each circular portion having partially cut fold-out wing portions. The substantially rectangular portions, which form two of the walls of the container, have margin portions along their perimeters which form the remaining four walls of the container when they are folded into place. A first circular portion is integral to a selected margin portion, while the second circular portion is connected to the first by a bridge which also functions as a stand for the assembled dispensing reel. The fold-out wing portions are folded into the center of the reel to form a spindle upon which a spool of dispensable product such as cable is to be mounted. In one embodiment, the fold-out wing portions have interlockable tabs that provide means for locking the wing portions together into a secure spindle configuration.

15 Claims, 9 Drawing Figures

UNITARY FOLDABLE DISPENSER REEL AND CONTAINER WITH REMOVABLE DISPENSER PORTION

BACKGROUND OF THE INVENTION

This invention relates generally to containers, particularly those that may be utilized for packaging, shipping and dispensing spools of wire, cable and the like.

More specifically, this invention relates to a combined container and dispenser reel that inexpensively provides means for both housing a spool of cable and the like during shipment thereof and housing said spool of cable and the like during actual dispensing and use thereof. This invention also relates to an inexpensively manufactured, combined packaging and dispensing means for a spool of cable and the like, in which said spool of cable may be mechanically engaged and locked into place within said container and dispensing device without a need for any special tools or components that would otherwise add to the cost of manufacturing.

STATEMENT OF THE PRIOR ART

In the cable and wire industry, it is generally accepted that the cost of providing suitable means for shipping such products, and for thereafter containing and dispensing such products, adds substantially to the overall cost of the product. Accordingly, it has been desirable to provide such packaging means and dispensing means as inexpensively as possible by utilizing low cost material and by combining as many functions as feasible. It is, of course, desirable to have a container for spools of cable, wire and the like that is inexpensive and lightweight, but that still provides a secure package in which the contained product may be safely shipped to a consumer and arrive undamaged and ready to use. It is also desirable to provide a device which permits convenient dispensing of said wire or cable contained therein whereby the wire or cable may be reeled out of said container or dispenser most conveniently for use while still providing a means for storing said spool of wire or cable, but without adding substantially to the cost of the end product. Furthermore, it is desirable to provide a secure form of packaging a spool of wire or cable in transit to a customer and also, thereafter, in use, so that the customer may obtain full benefit of the entire spool of wire or cable without damage thereto and with a maximum of convenience. Still further, it is desirable to provide an integral cut and scored blank which can be readily folded into a secure combined dispenser and container, but which provides the user with a detachable and independently functional dispenser unit.

Although various devices, such as the dispensing carton disclosed in U.S. Pat. No. 2,890,821 to Becker, provide some of the advantageous features of a unitary carton and dispensing device for spools of wire and the like, no device known to applicants provides all the combined features indicated above. For example, Becker's device makes it inherently impossible to detach the dispensing portion and use it independently of the container. U.S. Pat. No. 3,229,812 to Metzger, also discloses a unitary container and dispenser which is suitable for housing a spool of wire, but like Becker, fails to disclose a detachable and independently functional dispenser portion which gives a user the option of removing the dispenser from the carton at any time during its use.

Other, less relevant, prior art patents are listed below:

| Patent No. | Inventor |
|---|---|
| 1,821,354 | Meyer |
| 2,353,456 | Gluck et al |
| 2,788,892 | Dales |
| 2,879,022 | Hennessey et al |
| 3,166,187 | Araujo |
| 3,477,624 | Branyon et al |
| 3,913,786 | Kartasuk |
| 4,006,854 | Gibson et al |

SUMMARY OF THE INVENTION

The present invention substantially overcomes or reduces the disadvantages of prior art containers and dispensers for spools of wire, cable and the like by providing a combined container and dispenser reel that is integrated into a unitary foldable structure, preferably made of inexpensive corrugated paperboard that may be fabricated in a flat or planar configuration, easily cut to appropriate dimensions, and provided with fold creases or score lines that make it readily foldable around a spool of cable, wire, or the like. By means of the present invention, the functions of both containing said spool of wire, cable and the like for shipment thereof and for dispensing said wire, cable and the like, are combined in a unitary structure which includes a readily removable dispenser portion and which is less costly to manufacture than known prior separate function devices. Thus, by means of the present invention, it is more readily possible for manufacturers of wire, cable and the like to either decrease the selling price of said products to customers thereof, or in the alternative, to earn a greater profit from the sale thereof at current prices. Furthermore, the present invention provides novel spindle core means that is also integrated into the unitary structure of the invention and which provides mounting means for said spool of cable, wire and the like, which may be interlocked into place, thereby adding further to the security of said packaging and dispensing means. In addition, the current invention provides a stand feature on said dispensing means which readily lends itself to supporting said dispensing means in a stable configuration, even after it is separated from said container and used independently thereof.

Thus, it is an object of the present invention to provide a combined container and dispenser reel for spools of wire, cable and the like, that substantially overcomes the disadvantages of the prior art.

It is also an object of the present invention to provide a combined dispenser reel and container for spools of wire, cable and the like, in the form of an integrated, unitary foldable structure which is suitable for the shipping, dispensing, and protection of such products.

It is still a further object of the present invention to provide a combined container and dispenser reel for housing and using spools of wire, cable and the like, which includes means for forming a spindle core upon which such spools may be mounted in a securely locked configuration.

It is still a further object of the present invention to provide a combined containing, dispensing, and securing means readily adapted to house a spool of wire, cable and the like, which is fabricated as a unitary structure out of flat material that is readily folded into a configuration to house such products and which includes a detachable spool dispenser portion.

BRIEF DESCRIPTION OF THE DRAWINGS

In addition to above noted objects and advantages, others will become evident hereinafter as a result of the following description of a preferred embodiment of the invention described by way of example and illustrated in the accompanying drawings in which.

DESCRIPTION OF A PREFERRED EMBODIMENT

Figure 1:
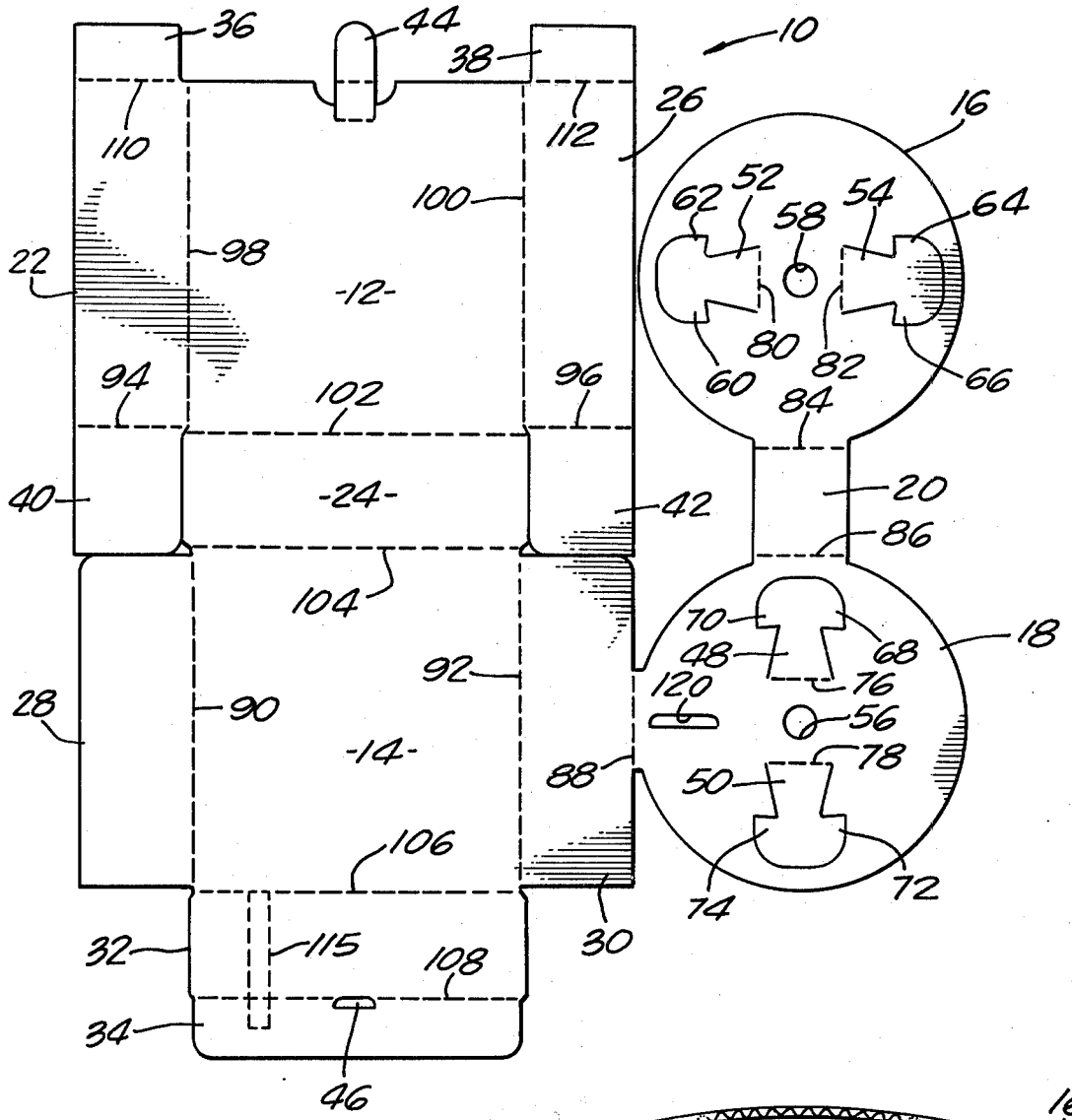
FIG. 1 is a plane view of the present invention in its fully unfolded planar configuration.

Referring now to FIG. 1, there is shown therein a view of a fully unfolded configuration of the present invention 10 having a first rectangular portion 12, a second rectangular portion 14, a first circular portion 16, and a second circular portion 18. The circular portions 16 and 18, also hereinafter referred to as flange members, are connected to one another by bridge 20 and, in turn, second circular portion or flange member 18 is connected to second rectangular portion 14. Thus, as shown in the fully unfolded flat configuration of FIG. 1, the present invention is a unitary strucure which may be fabricated in a planar configuration, thus making it simple and relatively inexpensive to fabricate by way of example, with a steel rule cutting die on a material that is readily cut and folded for use as a container, such as corrugated paperboard.

Although there is theoretically no limitation for the dimensions of the present invention, the diameter of circular portions 16 and 18 is typically within the range of four inches to fifteen inches, depending upon the application for the container. The lower end of the range of diameters for circular portions 16 and 18 is limited only by the thickness of the material selected and the difficulty in folding such material to such small dimensions. The maximum diameter is a function of the total weight of the spool of wire, cable and the like that is packaged within the container of that size. Even larger containers may be feasible, depending again upon the thickness of the material used and the degree of difficulty in folding such material. In one typical embodiment, the diameter of circular portions 16 and 18 is approximately nine inches, with the dimensions of rectangular portions 12 and 14, as well as the remaining surfaces of the container, being commensurate in size. In this typical embodiment having nine inch diameter circular members, the corrugated paperbord used in B flute and is of sufficient strength to pass a 275 pound Mullin test.

Rectangular portion 12 includes three margin portions along three of its four sides; namely, margin portions 22, 24, and 26. Margin portions 22 and 26 are called side margins, while margin portion 24 is called a bottom margin. Rectangular portion 14 also has three margins; namely, side margins 28 and 30, and top margin 32. As indicated in FIG. 1, rectangular portion 14 is connected to rectangular portion 12, along bottom margin 24.

As further shown in FIG. 1, rectangular portion 12 also includes top flaps, or lid flaps, 36 and 38, bottom flaps 40 and 42, and a lid tongue 44, which is designed to frictionally engage the walls of aperture 46 that is cut through the fold crease 108 between top margin 32 and margin lip 34.

Figure 3:
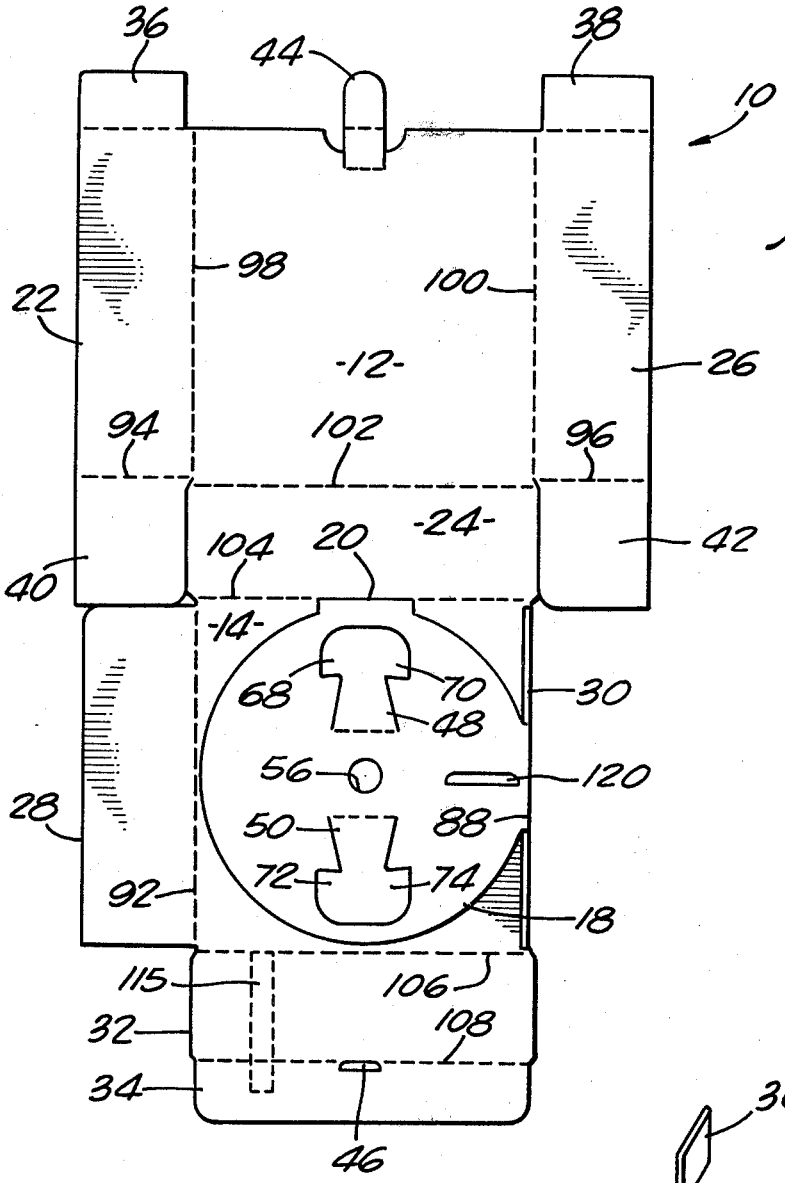
FIG. 3 is a plane view of the present invention in a subsequent partially folded configuration.

In order to facilitate an understanding of the manner in which the present invention may be folded into its fully assembled configuration, dotted lines are utilized in the drawing of FIGS. 1 and 3 to represent fold creases around which various surfaces of the invention may be folded to provide the completed dispensing container. Thus, on rectangular portion 12, these fold creases are identified as 94 and 96 for folding bottom flaps 40 and 42, respectively, 98 and 100 for folding side margins 22 and 26, respectively, and 110 and 112 for folding top flaps or lid flaps 36 and 38, respectively. Similarly, rectangular portion 14 includes fold creases 90 and 92 for folding side margins 28 and 30, respectively, and 106 and 108 for folding top margin 32 and margin lip 34, respectively. In addition, bottom margin 24 includes fold crease 102 along the border with the remainder of rectangular portion 12 and fold crease 104 at the interface with rectangular portion 14.

Referring now to the circular portions 16 and 18 of FIG. 1, it will be seen that circular portion 18 includes fold-out wings 48 and 50, while circular portion 16 includes fold-out wings 52 and 54. Each circular portion includes a centrally located circular aperture 56 and 58. Each of the fold-out wings is cut along all its edges except one, which is in the form of a fold crease to permit the wing to be folded into a roughly perpendicular orientation with respect to the circular portion to which it is connected. Thus, fold-out wing 48 of circular portion 18 has a fold crease 76. Fold-out wing 50 of circular portion 18 has a fold crease 78. Fold-out wing 52 of circular portion 16 has a fold crease 80 and fold-out wing 54 of circular portion 16 has a fold crease 82.

Each of the fold-out wings 48, 50, 52, and 54 has a pair of wing tabs which, as will be seen hereinafter, provides a means of interlocking said fold-out wings to form a spindle or hub member between circular members 16 and 18 when they are folded into parallel relation to one another within the container 10 of the present invention. Thus, fold-out wing 48 includes tabs 68 and 70, fold-out wing 50 includes tabs 72 and 74, fold-out wing 52 includes tabs 60 and 62, and fold-out wing 54 includes tabs 64 and 66.

Bridge 20, which interconnects circular portions 16 and 18, includes fold creases 84 and 86 at the intersection lines with the outer perimeter of the circular portions to provide means for easily folding the two circular portions into parallel relation to one another.

In the embodiment illustrated in FIG. 1, circular portion 18 is additionally cut to provide an elongated aperture 120 which permits a user to monitor the amount of cable and the like remaining in the dispenser.

It will be understood, therefore, that FIG. 1 provides a planar view of the present invention before any of the various surfaces have been folded in the process of assembling the invention to form a combined dispenser and container for spools of wire, cable and the like.

FIG. 1 and FIGS. 3 through 6, which are included herein to disclose the manner in which the present invention may be folded around a spool of cable, show only the invention and omit the spool of cable to avoid obscuring the invention per se. It is to be understood however, that the primary purpose of the present invention is to provide a container and dispenser for a spool of cable. Accordingly, reference is now made to FIG. 2, in which a cable spool core 122, which ordinarily would have a cable, wire, or the like wound thereupon, is shown installed for containing and dispensing within the present invention.

Figure 2:
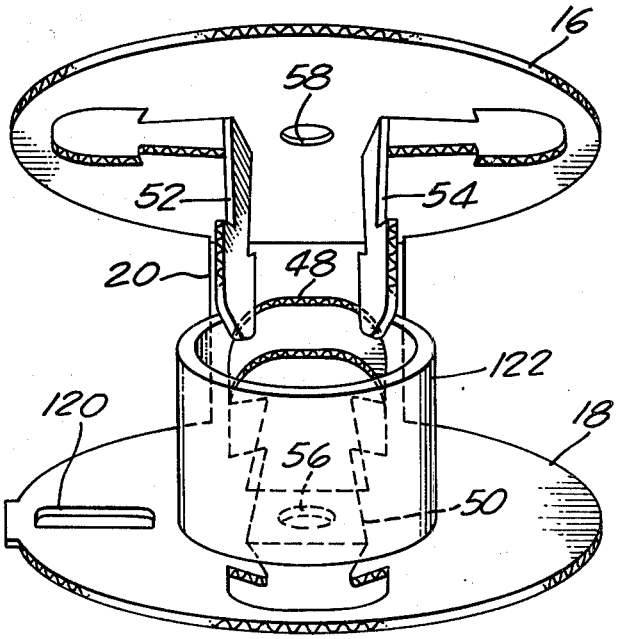
FIG. 2 is an isometric view of the dispenser portion of the present invention in a partially folded configuration with a cable core to be secured therein.

As shown in FIG. 2, the cable core 122 is placed upon fold-out wings 48 and 50 of circular portion 18 with the fold-out wings bent up substantially perpendicular to portion 18. The fold-out wings and particularly the tabs thereof mechanically engage the interior cylindrical surface of core 122. Circular portion 16 is then folded into parallel relation with circular portion 18 with its fold-out wings, 52 and 54 also folded into substantial perpendicularity with circular portion 16. As circular portion 16 is so folded, fold-out wings 52 and 54 are also inserted within core 122 to mechanically engage the inside surface thereof. As the folding of circular portion 16 is continued until the parallel relationship with circular portion 18 is achieved, the fold-out wings are inserted within core 122 until the four fold-out wings, 48, 50, 52, and 54 comprise a locked hub arrangement in which the fold-out wings are mechanically engaged with one another as well as with core 122.

Reference will now be made to FIGS. 3 through 6, which illustrate how the present invention may be fully folded into its enclosed configuration. However, as previously indicated, the cable, and core have been omitted from these drawings to provide the clearest indication of how the present invention may be so folded.

FIG. 3 represents a view of the present invention that is similar to the view of FIG. 1 except that the circular portions 16 and 18, bridge 20, and side margin 30 of rectangular portion 14 have been folded into their respective positions for assembling the present invention.

To accomplish the transition from the flat configuration of FIG. 1 to the partially folded configuration of FIG. 3, circular portion 16 has been folded approximately 90 degrees up out of the plane of the drawing of FIG. 1 around fold crease 84. Then, the combination of circular portion 16 and bridge 20 has been folded an additional 90 degrees around fold crease 86 until the two circular portions 16 and 18 are in spaced parallel relationship to one another.

It is to be understood that when a spool of cable is to be enclosed in the invention, the spool is placed concentrically over fold-out wings 48 and 50 which are raised into their folded position approximately perpendicular to circular portion 18. Then circular portion 16 is folded into parallel relation to portion 18 with fold-out wings 52 and 54 approximately perpendicular to portion 16 and inserted into position in the core of the spool of cable. The four fold-out wings are thereby locked into mechanical engagement with each other and with the spool core.

The combination of circular portions 16 and 18 and bridge 20 is then folded 90 degrees around fold crease 88 towards rectangular member 14, upwardly out of the plane of the drawing of FIG. 1 until both circular portions 16 and 18 are substantially perpendicular to the remaining surfaces of the invention 10. Finally, to achieve the configuration depicted in FIG. 3, the combination of circular portions 16 and 18, bridge 20, and side margin 30 of rectangular portion 14, is folded an additional 90 degrees around fold crease 92 until the circular portion 16 lies flatly upon the rectangular portion 14, with circular portion 18 parallel to circular portion 16 and in spaced relation thereto above the plane of rectangular portion 14. Clearly in this configuration, as depicted in FIG. 3, bridge 20 and side margin 30 are both substantially perpendicular to the plane of FIG. 3 and thus perpendicular to the rectangular members 12 and 14. As shown in FIG. 3, none of the other surfaces of the invention have, as yet, been folded into place, and in the folding process time frame depicted in FIG. 3, those other surfaces remain in the same configuration as depicted in FIG. 1.

Figure 4:
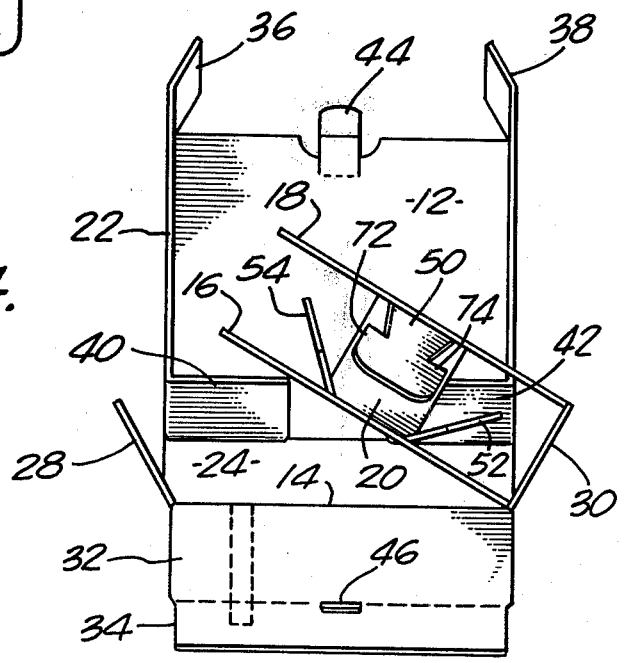
FIGS. 4 and 5 are isometric front and side views, respectively, of the present invention in a still subsequent partially folded configuration, but with the detachable portion partially raised for purposes of explanation.
Figure 5:
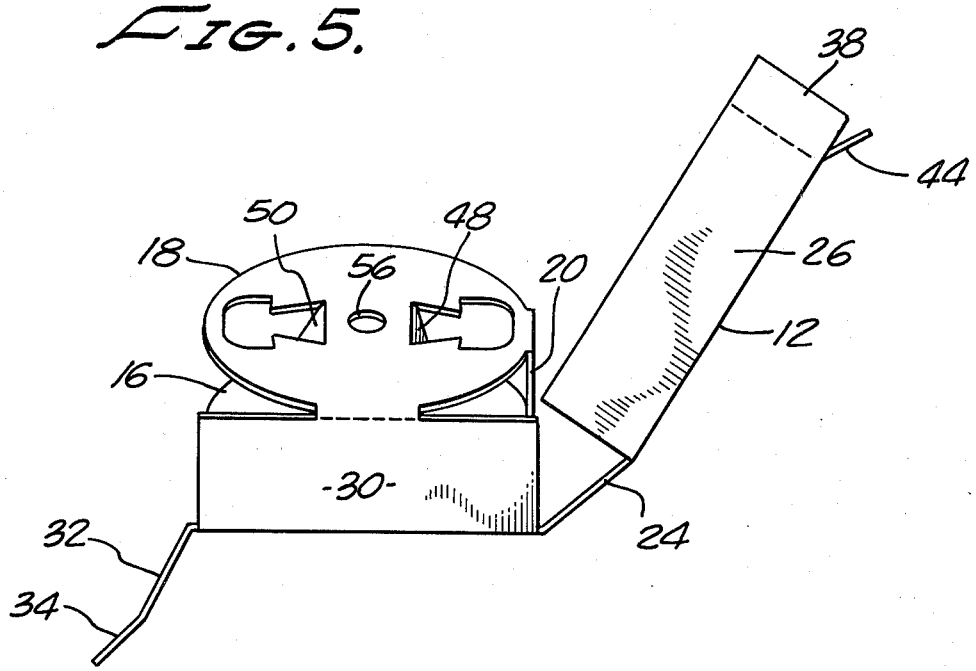

Referring now to FIGS. 4 and 5, it will be seen that the various surfaces of the invention comprising container 10 have been further folded in furtherance of the assembly of the container and dispenser. FIG. 4 is a front view, taken perpendicular to the plane of rectangular portion 14, and FIG. 5 is a corresponding right side view showing that rectangular portion 12 is bent up to something less than 90 degrees in relation to rectangular portion 14. In addition, each of the side margins 22 and 26 of rectangular portion 12 have been bent up to be perpendicular to rectangular portion 12, while top flaps or lid flaps 36 and 38 have been bent partially toward lid tongue 44. Top margin 32 and margin lip 34 are shown bent below the plane of rectangular portion 14. Circular portions 16 and 18 are shown in their normal parallel relation to one another, but inclined to rectangular portion 14, with side margin 30 of rectangular portion 14 being only partially bent up towards its assembled 90 degrees relation to rectangular portion 14. Side margin 28 is also only partially bent up towards its assembled 90 degree configuration with respect to rectangular portion 14. Bottom flaps 40 and 42 are bent up into their final configuration perpendicular to side margins 22 and 26 of rectangular portion 12. All of the fold-out wings are partially folded out towards the opposite circular portion and bridge 20 is in position bridging the circular portions 16 and 18 and perpendicular to their parallel planes.

Figure 6:
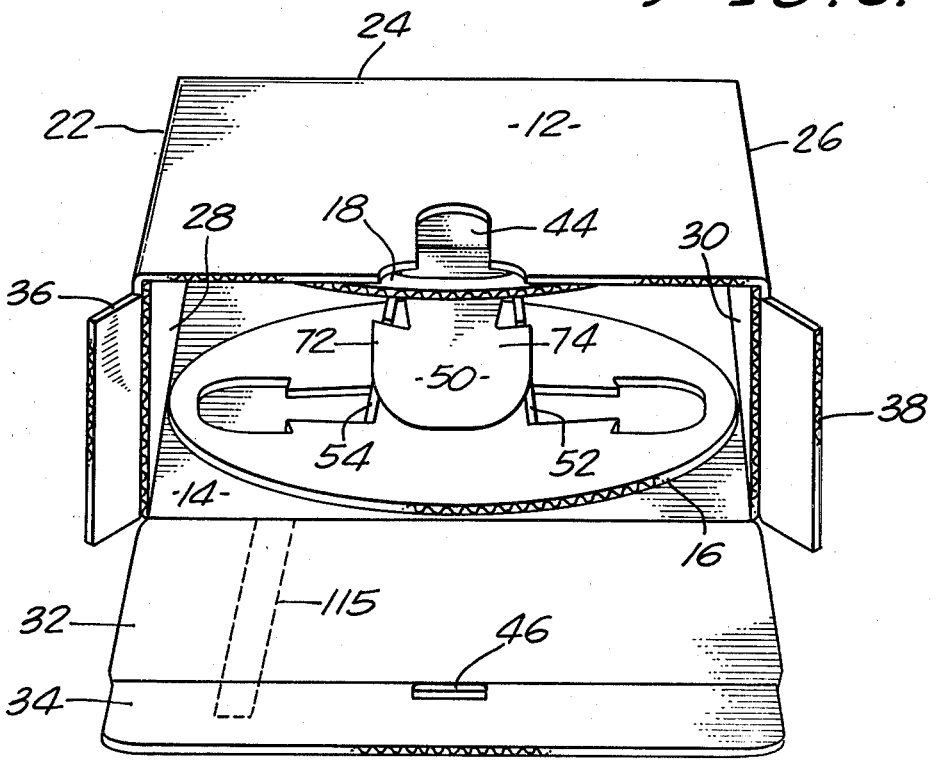
FIG. 6 is an isometric view of the present invention shown in its substantially folded configuration.

FIG. 6 is an isometric enlarged view of the present invention in its virtually completely folded configuration. The only remaining folding to complete assembly of the container would be to fold flaps 36 and 38 fully toward each other and then to fold lid margin 32 with margin lip 34 being positioned between rectangular portion 12 and circular portion 18, with lid tongue 44 slipping into the aperture 46 as the container is closed.

As shown in FIG. 6, the fold-out wings are now fully deployed with wings 52 and 54 of the lower positioned circular portion 16 being bent upwardly towards circular portion 18, and fold-out wing 50, of the two wings folded out of circular portion 18, being fully folded toward the lower circular portion 16. In addition, wing tabs 72 and 74 are shown engaging the corresponding wing tabs of fold-out wings 52 and 54 to create a locking engagement between the fold-out wings of the two circular portions 16 and 18. This locking engagement provides a secure spindle arrangement upon which a spool of wire, cable and the like is mounted. Of course, it will now be apparent that a spool of wire, cable or the like would ordinarily be placed between and slipped over the fold-out wings of both circular portions 16 and 18 before the fold-out wings are placed in locking engagement (see FIG. 2). Ordinarily, the interior cylindrical surface of the spool upon which the wire or cable is wound, will provide a mechanical constraint to the fold-out wings to further secure them in locked engagement.

A rectangular perforation, represented by dotted line 115 on the top margin 32 and margin lip 34, provides an easily removable segment which creates a dispensing port or aperture for selectively reeling out the wire or cable mounted on the dispenser.

Figure 7:
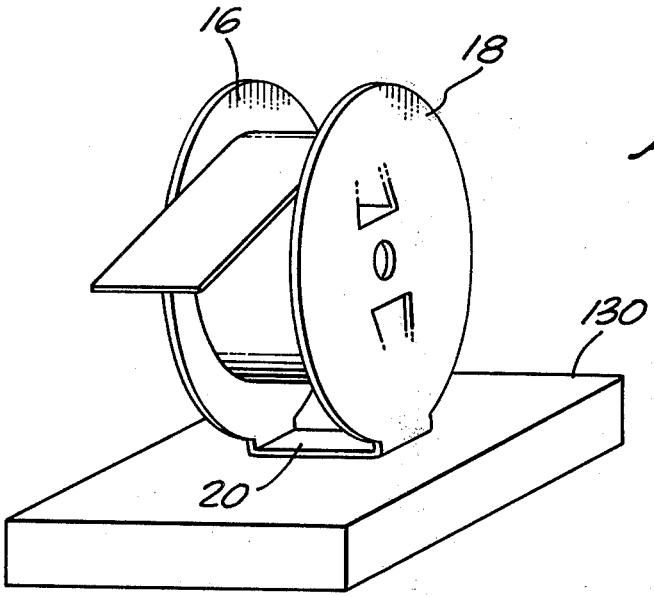
FIGS. 7 and 8 illustrate alternative ways in which the detachable portion of the present invention may be used to dispense cable.
Figure 8:
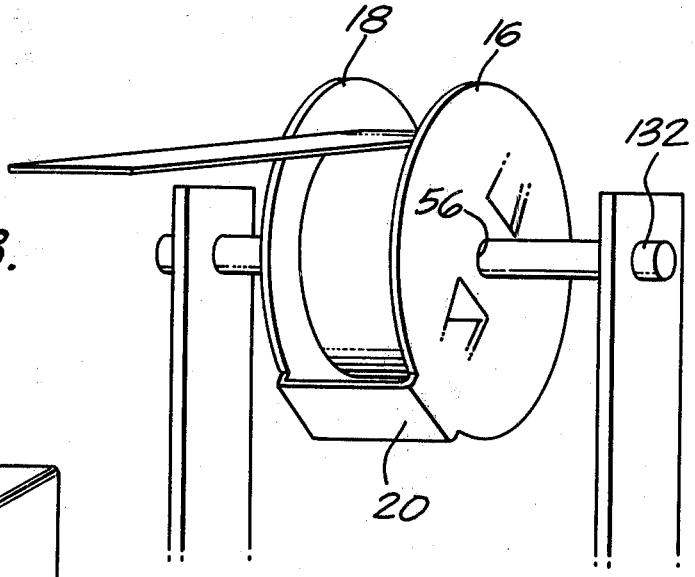

FIGS. 7 and 8 are included herein to illustrate the manner in which the dispenser portion of the invention may be used in its detached mode, independent of the container portion of the invention. As illustrated in FIG. 7, the dispenser may rest in a stable configuration with bridge 20 providing sufficient flat surface area to prevent the circular portions, 16 and 18 from rolling along a surface 130. This is presently contemplated as a storage mode for the cable installed within the illustrated embodiment of present invention. However, this does not preclude the configuration illustrated in FIG. 7 from being used also as a dispensing mode with bridge 20 being secured to a surface and with sufficiently low friction between the cable core and the dispenser to permit rotation and reeling out of the cable without pulling bridge 20 and the dispenser from the surface.

FIG. 8 illustrates a dispensing mode for the present invention in which a spindle 132 is inserted through apertures 56 and 58 of circular portions 18 and 16, respectively, so that the dispenser portion of the invention may be hung in a readily rotatable configuration.

Figure 9:
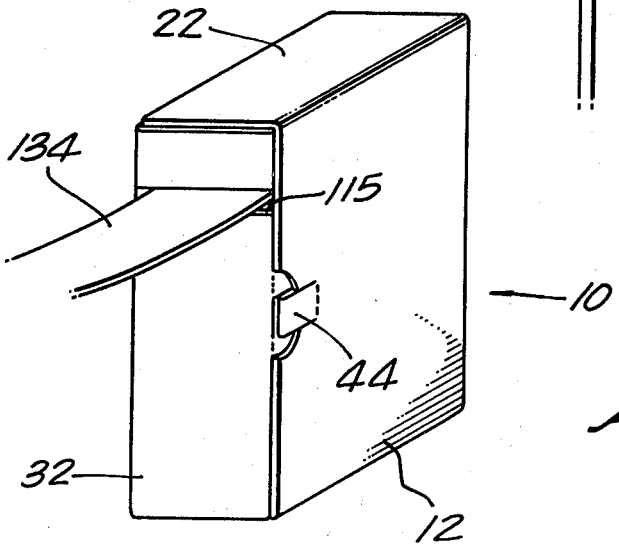
FIG. 9 illustrates the manner in which cable may be reeled out of the container and dispenser combination.

FIG. 9 is included herein to illustrate the manner in which cable may be reeled out of the container and dispenser combination 10. As illustrated in FIG. 9, the invention is in its fully folded and assembled configuration in which the removable segment, provided by rectangular perforation 115 of FIG. 6, has been completely removed providing an aperture through which cable 134 may be reeled out of the invention. In the view of FIG. 9, rectangular portion 12 and margins 22 and 32 are visible. In addition, tongue 44 is shown in place thereby securing the fully assembled container 10.

It will now be readily apparent that what has been disclosed herein is a novel, foldable container for both containing and dispensing wire wound on a spool. The container is formed of a unitary structure that may be readily fabricated from a flat single piece of material suited for relatively easy cutting and folding and for containing a spool of wire, cable and other such materials of the type for which the present invention is most suitable.

Although a specific embodiment of the invention has been disclosed herein, it will now be apparent to those having ordinary skill in the art to which the invention pertains, that many other embodiments of the invention may be constructed. For example, in view of applicant's teaching herein disclosed, it will now be apparent that there may be variations in materials, dimensions and basic design that would permit substantial deviation from the specific configuration disclosed herein by way of example. Accordingly, the invention is not deemed to be limited except as defined by the appended claims.

We claim:

1. A foldable container for both containing and dispensing wire wound on a spool, the container being of unitary structure and comprising:

a. a first substantially rectangular portion having foldable margin portions along three sides thereof;

b. a second substantially rectangular portion connected to said first substantially rectangular portion at a margin thereof and having foldable margin portions along three sides thereof;

c. a first substantially circular portion tangentially connected to a margin portion of said second substantially rectangular portion;

d. a second substantially circular portion spaced from said first substantially circular portion;

e. a bridge tangentially connected to said first and second substantially circular portions for supporting said circular portions substantially parallel to each other when folded; and f. spindle means adapted for placement between said first and second substantially circular portions when said circular portions are folded into said parallel relation, whereby said spindle means may receive said spool of wire for selective dispensing thereof.

2. The foldable container recited in claim 1, wherein said spindle means comprises:

locking means for securing said circular portions in spaced parallel relation to each other.

3. The foldable container recited in claim 1, wherein said spindle means comprises:

fold out wings each foldably connected to one of said circular portions for forming a portion of said spindle means when folded toward the opposing circular portion.

4. The foldable container recited in claim 3, wherein said spindle means further comprises:

locking tabs integral with each said fold out wing for mechanically engaging the fold out wing of the opposite circular portion.

5. The foldable container recited in claim 3, wherein said spindle means further comprises:

an even number of said fold out wings having dimensions substantially equal to each other, half of said number of said fold out wings being connected to one of said circular portions and being spaced symmetrically around the center thereof, and the remaining half of said number of said fold out wings being connected to the other of said circular portions and being spaced symmetrically around the center thereof.

6. The foldable container recited in claim 1, wherein a margin portion of said second substantially rectangular portion is at least partially perforated to provide a dispensing aperture through which said wire may be selectively reeled out of said container.

7. The foldable container recited in claim 1, wherein said bridge is of sufficient dimension to provide a stable platform for a spool of wire when said first and second substantially circular portions and spindle means are disconnected from the remainder of said container and removed therefrom.

8. The foldable container recited in claim 1, wherein said first substantially rectangular portion has a lid tongue extending from a side having no foldable margin portion and said second substantially rectangular portion has a lid perforation adapted to provide an aperture to receive said lid tongue when said container is fully folded.

9. The foldable container recited in claim 1, wherein said first substantially circular portion is cut to provide an aperture for monitoring the amount of wire remaining on said spindle means.

10. A combined container and dispenser formed of a unitary planar foldable material which in a fully folded configuration comprises:

a. container means having a plurality of interconnected surfaces forming a substantially enclosed volume therein, and b. dispenser means having opposing substantially parallel flange members interconnected by a bridge member, one of said flange members being connected at its edge to an edge of one of said surfaces, and each of said flange members having at least one fold out wing, each said wing being foldably connected to a flange member and being foldable toward the opposing flange member to form a hub between said flange members.

11. The combined container and dispenser recited in claim 10, wherein said dispenser means further comprises:

locking tabs integral with each said fold out wing for mechanically engaging the fold out wing of the opposite flange member.

12. The combined container and dispenser recited in claim 10, wherein said dispenser means further comprises:

an even number of said fold out wings having dimensions substantially equal to each other, half of said number of said fold out wings being connected to one of said flange members and being spaced symmetrically around the center thereof, and the remaining half of said number of said fold out wings being connected to the other of said flange members and being spaced symmetrically around the center thereof.

13. The combined container and dispenser recited in claim 10, wherein at least one of said surfaces is at least partially perforated to provide a dispensing aperture.

14. The combined container and dispenser of claim 10, wherein said bridge member is of sufficient dimension to provide a stable platform for a spool of wire mounted on the hub of said dispenser means when said flange members and said hub are disconnected from said container means and removed therefrom.

15. The combined container and dispenser of claim 10, wherein at least one of said flange members is cut to provide an aperture for monitoring the amount of wire remaining on said dispenser means.

* * * * *